United States Patent [19]

Seko

[11] Patent Number: 4,545,174

[45] Date of Patent: Oct. 8, 1985

[54] TIMING ADJUSTING DEVICE FOR PACKAGING MACHINES

[75] Inventor: Kiyoshi Seko, Nagoya, Japan

[73] Assignee: Fuji Machinery Co., Ltd., Nagoya, Japan

[21] Appl. No.: 486,355

[22] Filed: Apr. 19, 1983

[30] Foreign Application Priority Data

Apr. 19, 1982 [JP] Japan ..... 57-65116

[51] Int. Cl.[4] ..... B65B 41/18

[52] U.S. Cl. ..... 53/51; 53/75; 318/569; 364/561

[58] Field of Search ..... 53/75, 51, 507; 364/561; 318/569

[56] References Cited

U.S. PATENT DOCUMENTS

| | | | |
|---|---|---|---|
| 3,943,683 | 3/1976 | Kovacs et al. | 53/51 |
| 4,316,566 | 2/1982 | Arleth et al. | 53/51 |
| 4,349,997 | 9/1982 | Hayasaka et al. | 53/51 |
| 4,391,079 | 8/1983 | Cherney | 53/51 |

*Primary Examiner*—Leonidas Vlachos
*Attorney, Agent, or Firm*—Armstrong, Nikaido, Marmelstein & Kubovcik

[57] ABSTRACT

A packaging machine wraps an article with a web of patterned wrapping paper as it is continuously formed into a sleeve, and seals or cuts or both seals and cuts the front and rear ends of a sleeve enclosure in which the article is wrapped. A timing adjustment device for the packaging machine includes input means for setting an operating pitch of a seal cutter or the like and a thickness of the article, a processor for computing an initial angle or position of the seal cutter or the like based on the settings for the operating pitch and the article thickness to establish timing of operation of the seal cutter or the like with respect to the article fed by a feed conveyor and the patterned wrapping paper and for issuing a control signal based on the result of computation, and a control motor for adjusting a timing mechanism for the seal cutter or the like based on the control signal.

6 Claims, 4 Drawing Figures

TIMING ADJUSTING DEVICE FOR PACKAGING MACHINES

BACKGROUND OF THE INVENTION

The present invention relates to a device for adjusting the timing of a seal cutter, a sealer or a cutter in preparation for starting the operation of a packaging machine.

There are known packaging machines for wrapping articles with a web of patterned wrapping paper as it is continuously formed into a sleeve, sealing the ends of a sleeve enclosure with an article therein, and finally cutting off the sleeve enclosure at the sealed ends. With such packaging machines, it is necessary to detect registration marks printed at the pitch of the patterns on the wrapping paper and drive a rotary seal cutter in timed relation to passage of the registration marks in order to produce packages aligned with patterns printed on the wrapping paper.

When different articles are to be packaged or a different web of patterned wrapping paper is to be used, it has been customary practice for the operator to make adjustments in preparation for the operation of the packaging machine. Such preparatory adjustments include readjustment of the cutting pitch of the rotary seal cutter, that is, the interval at which the wrapping paper is to be cut off, initial adjustment of the angle of the rotary seal cutter with respect to an attachment on a feed conveyor, and adjustment of the timing at which to detect registration marks on the wrapping paper with the rotary seal cutter serving as a reference. These preparatory adjustments have been effected manually by the operator, and hence are low in efficiency and require much skill on the part of the operator. Where the adjustment made is subjected to an error, or something is left to be adjusted, many articles are wrapped improperly.

In case articles of a different thickness are to be wrapped by wrapping paper having registration marks spaced at equal intervals, it is necessary to change the cutting pitch of the rotary seal cutter based on the registration mark interval. However, the thickness of the articles cannot be entered as a setting into the conventional device for adjusting the timing of the seal cutter. This fails to make exact ajustment to meet the change in the thickness of the articles. Therefore, it has not been possible to seal and cut the wrapping paper at correct positions when the thickness of articles is varied.

SUMMARY OF THE INVENTION

It is an object of the present invention to provide a timing adjustment device for packaging machines which is capable of automatically adjusting an initial angle or position of a seal cutter, a sealer or cutter with respect to an attachment of an article feed conveyor, and the timing at which to supply patterned wrapping paper to the seal cutter, sealer or cutter, as preparatory adjustments prior to the starting of operation of the packaging machine.

Another object of the present invention is to provide a timing adjustment device for packaging machines which is capable of automatically adjusting the timing at which to operate a seal cutter, a sealer or a cutter with respect to articles wrapped even when the thickness of the articles is changed by entering a setting for the thickness of the articles.

According to the present invention, there is provided A timing adjustment device for a packaging machine, comprising input means for setting as digital signals values of an operating pitch of a seal cutter, sealer or cutter and a thickness of articles to be wrapped by a web of patterned wrapping paper, a memory for storing numerical data including a dimension from a feed conveyor to the seal cutter, sealer or cutter, a dimension from a registration mark pointer to the seal cutter, sealer or cutter, the operating pitch, the article thickness, an angle or position of the seal cutter, sealer or cutter, a processor for reading the dimensions and numerical values from the memory, computing an angle or position to derive timing of operation of the seal cutter, sealer or cutter with respect to the articles fed by the feed conveyor and the patterned wrapping paper, and feeding a control signal based on the result of computation to a motor drive control unit, a control motor coupled to a drive system for the seal cutter, sealer or cutter for adjusting the angle or position of the seal cutter, sealer or cutter with respect to the feed conveyor under the control of the motor drive control unit, a control motor connected to a timing mechanism for adjusting timing of operation of the seal cutter, sealer or cutter with respect to the patterned wrapping paper for adjusting a phase of the timing mechanism with the seal cutter, sealer or cutter serving as a reference under the control of a signal from the motor drive control unit, and a pulse generator for detecting an angular displacement of the drive system for the timing mechanism and the seal cutter, sealer or cutter and delivering a detected signal to the processor. The timing of operation of the seal cutter, sealer or cutter is adjusted on the basis of the entered settings for the operation pitch and the article thickness.

The above and other objects, features and advantages of the present invention will become more apparent from the following description when taken in conjunction with the accompanying drawings in which a preferred embodiment of the present invention is shown by way of illustrative example.

DESCRIPTION OF THE PREFERRED EMBODIMENT

Figure 1:
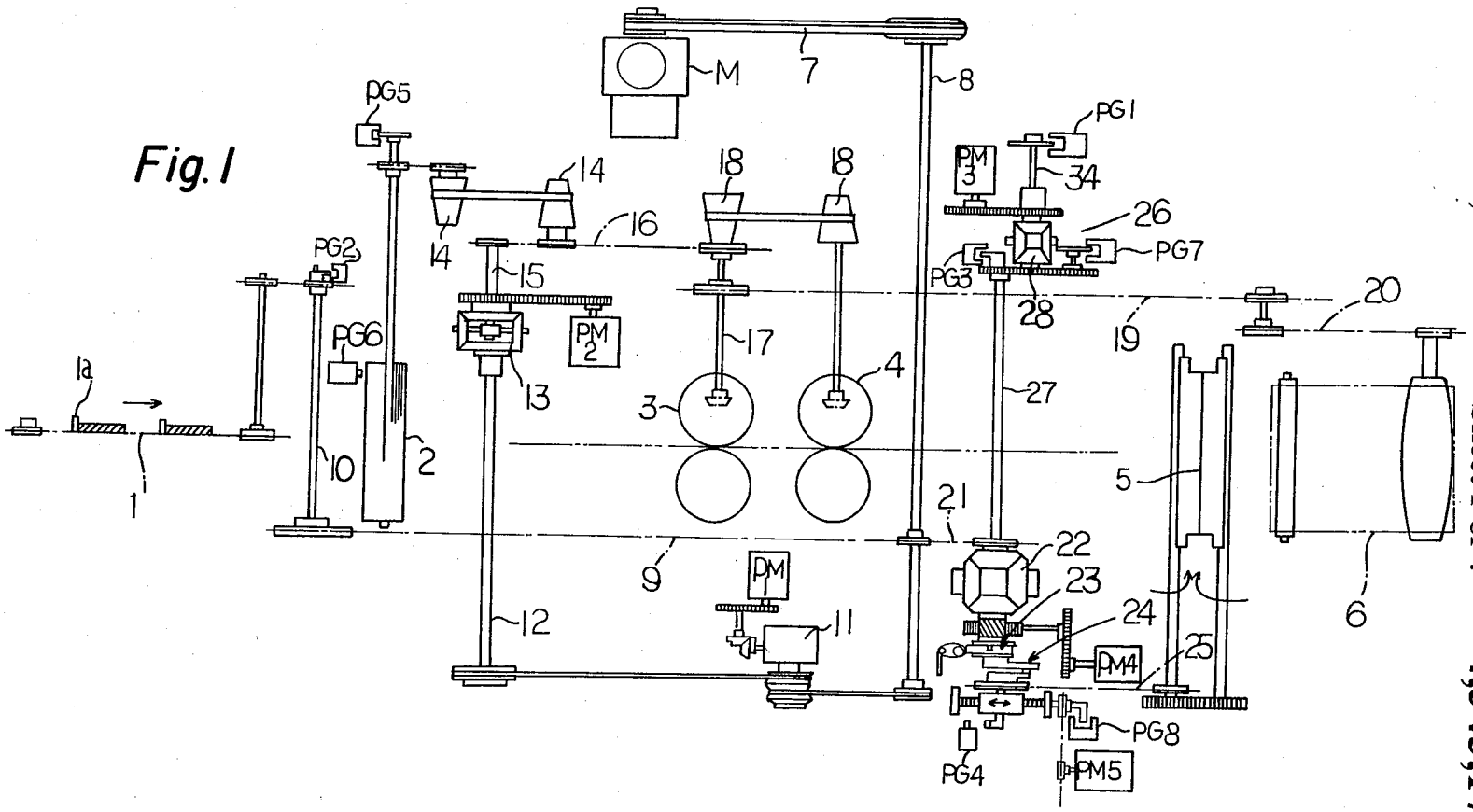
FIG. 1 is a plan view of a horizontal packaging machine for wrapping articles in sealed enclosures with a timing adjustment device of the invention being incorporated therein.
Figure 2:
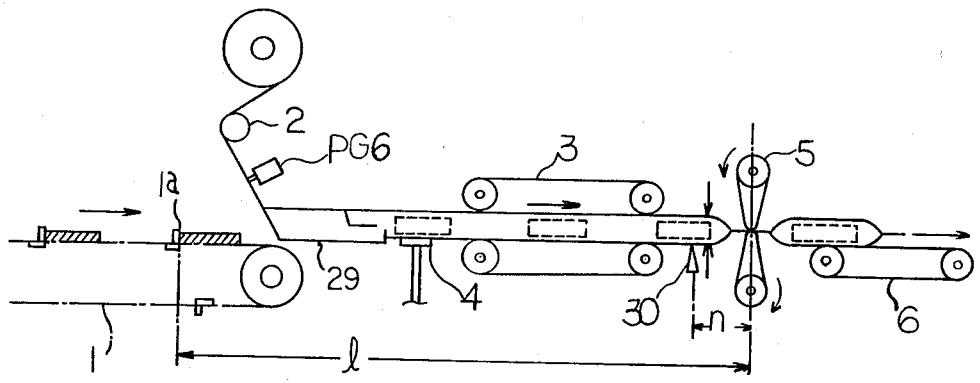
FIG. 2 is a side elevational view of the horizontal packaging machine shown in FIG. 1.

As shown in FIGS. 1 and 2, a horizontal packaging machine includes a feed converyor 1 having attachments 1*a* for supplying articles to be wrapped to a former 29, a feed roller 2 for feeding a web of patterned wrapping paper or film to the former 29, pulling rollers 3 for pulling the wrapping paper from the former 29, a center sealing unit 4 for sealing overlapping edges of the wrapping paper as it is formed into a sleeve, a rotary seal cutter 5 for sealing ends of packaging enclosures and cutting them off at the sealed ends, and a discharge conveyor 6 for discharging packaged articles.

Driving units and an automatic adjustment device for the packaging machine will be described in detail. Driving power from a main motor M is transmitted through an endless belt 7, a main drive shaft 8, a chain 9, and an intermediate shaft 10 to the feed conveyor 1. The feed roller 2 is driven to rotate by the main drive shaft 8 through a speed change unit 11 including belts, a drive shaft 12, a differential gear mechanism 13, an intermediate shaft 15, and a roller 14 for fine adjustment of the feed rate. The pulling rollers 3 are driven to rotate by the intermediate shaft 15 through a chain 16 and a drive shaft 17. The center sealing unit 4 is also actuated by the drive shaft 17 through fine adjustment rollers 18. The discharge conveyor 6 is driven by the drive shaft 17 through chains 19, 20. The rotary seal cutter 5 is driven by the main drive shaft 8 through a chain 21 connected to differential gear mechanism 22, a clutch mechanism 23, a variable-speed rotational mechanism 24 and a chain 25. A timing mechanism 26 for the rotary seal cutter 5 is operatively coupled to the main drive shaft 8 through a chain 21, differential gear mechanism 22, and an intermediate shaft 27. The timing mechanism 26 includes a timing cam shaft 34 coupled to the intermediate shaft 27 through a differential gear mechanism 28 for effecting initial adjustment of the angle of the rotary seal cutter 5 with respect to the attachments 1*a* on the feed conveyor 1 and the patterned wrapped paper and also for determining the timing with which these components operate. The speed change unit 11 is operatively connected to a control motor PM1 for changing the speed change ratio thereof. A control motor PM2 is operatively connected to an output shaft of the differential gear mechanism 13 through a gearing. A control motor PM3 for timing adjustment is operatively connected to an output shaft of the differential gear mechanism 28 of the timing mechanism 26 through a gearing. An output shaft of the differential gear mechanism 22 is operatively coupled via a gearing to a control motor PM4 which serves to effect initial adjustment of the angle of the rotary seal cutter 5. A control motor PM5 is operatively connected through a chain to a screw feeder for adjusting the eccentricity of a variable eccentric crank of the variable-speed rotational mechanism 24.

Pulse generators PG1 through PG8 are disposed adjacent to drive shafts for generating a number of pulses proportional to the degree of rotation of a shaft to be detected, or a pulse signal in response to detection of the movement of an object. More specifically, the pulse generator PG1 is located adjacent to a timing cam mounted on the timing cam shaft 34. The pulse generator PG2 is disposed adjacent to the intermediate shaft 10 which drives the feed conveyor 1. The pulse generator PG3 is positioned at an end of the intermediate shaft 27 for generating a signal for setting a zero position upon initial adjustment of the angle of the rotary seal cutter 5. The pulse generator PG4 serves to detect a zero position for the eccentricity in the variable-speed rotational mechanism 24. The pulse generator PG5 is placed at an end of the shaft of the feed roller 2. The pulse generator PG6 is positioned adjacent to the feed roller 2 for detecting registration marks printed on the patterned wrapping paper. The pulse generator PG7 is disposed adjacent to a detection shaft connected through gears to the intermediate shaft 27 for adjusting the angle of the rotary seal cutter 5 with respect to the attachments 1*a* on the feed conveyor 1. The pulse generator PG8 serves to adjust the eccentricity of the eccentric crank of the variable-speed rotational mechanism 24.

Figure 3:
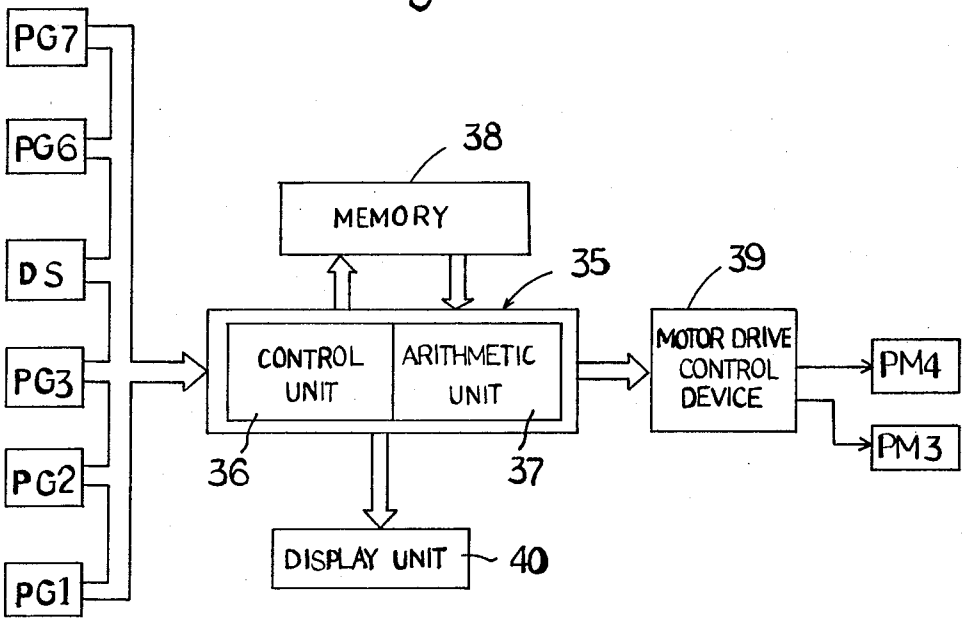
FIG. 3 is a block diagram of an electronic controller for controlling the timing adjustment device of the present invention.

FIG. 3 shows in block form an electronic controller for controlling a seal cutter timing adjustment device. The electronic controller comprises a processor 35 composed of a control unit 36 and an arithmetic unit 37 and connected to input devices including a digital switch DS for setting the thickness of articles to be wrapped and the pulse generators PG1, PG2, PG3, PG6, PG7. The control unit 36 processes input and output operations and also controls the execution of arithmetic operations. The arithmetic unit 37 operates under the control of a program stored in a memory 38 to compute an angle $\alpha$ of the rotary seal cutter 5 at the time the feed conveyor 1 is in a fixed position and an angle $\beta$ of the rotary seal cutter 5 at the time a registration mark is registered with a registration mark pointer 30 (FIG. 2) on the basis of stored numerical data according to predetermined arithmetic operations. The memory 38 stores at least the values of a cutting pitch and an article thickness, a distance l from an attachment 1*a* on the feed conveyor 1 at a fixed position to a central line of the rotary seal cutter 5, and a distance n from the registration pointer 30 to the central line of the rotary seal cutter 5. To the output of the processer 35, there is connected a motor drive control unit 39 for controlling the control motor PM4 for effecting initial adjustment of the angle of the rotary seal cuter 5 and the control motor PM3 for adjusting the timing of operation of the rotary seal cutter 5 with respect to a registration mark on the wrapping paper, on the basis of the results of the foregoing arithmetic operations. A display unit 40 such as a CRT, LED, LCD, or lamps is connected to the processor 35 for displaying a cutting pitch setting, a sensitivity adjustment request, and a request for registration between the pointer and the registration mark to enable the operator to make automatic setting and adjustment on an interactive basis.

Operation of the seal cutter timing adjustment device is as follows: Prior to timing adjustment for the rotary seal cutter, settings for a cutting pitch or cutting width and an article thickness are entered and the peripheral speed of the rotary seal cutter is adjusted. When the values of a cutting pitch and an article thickness are entered by the digital switch DS into the processor 35, these data items are delivered from the control unit 35 to the memory 38 for storage. An actual cutting pitch on the packaging machine is compared with the cutting pitch setting thus stored, and the control motor PM1 is actuated to equalize the actual cutting pitch and the setting therefor. The cutting pitch is established in this manner. The peripheral speed of the rotary seal cutter is adjusted by computing the eccentricity of the variable eccentric crank in the variable-speed rotational mechanism 24 based on numerical data such as the cutting pitch and the maximum crank eccentricity, and driving the control motor PM5 to bring the eccentricity of the variable eccentric crank into conformity with the computed value.

Figure 4:
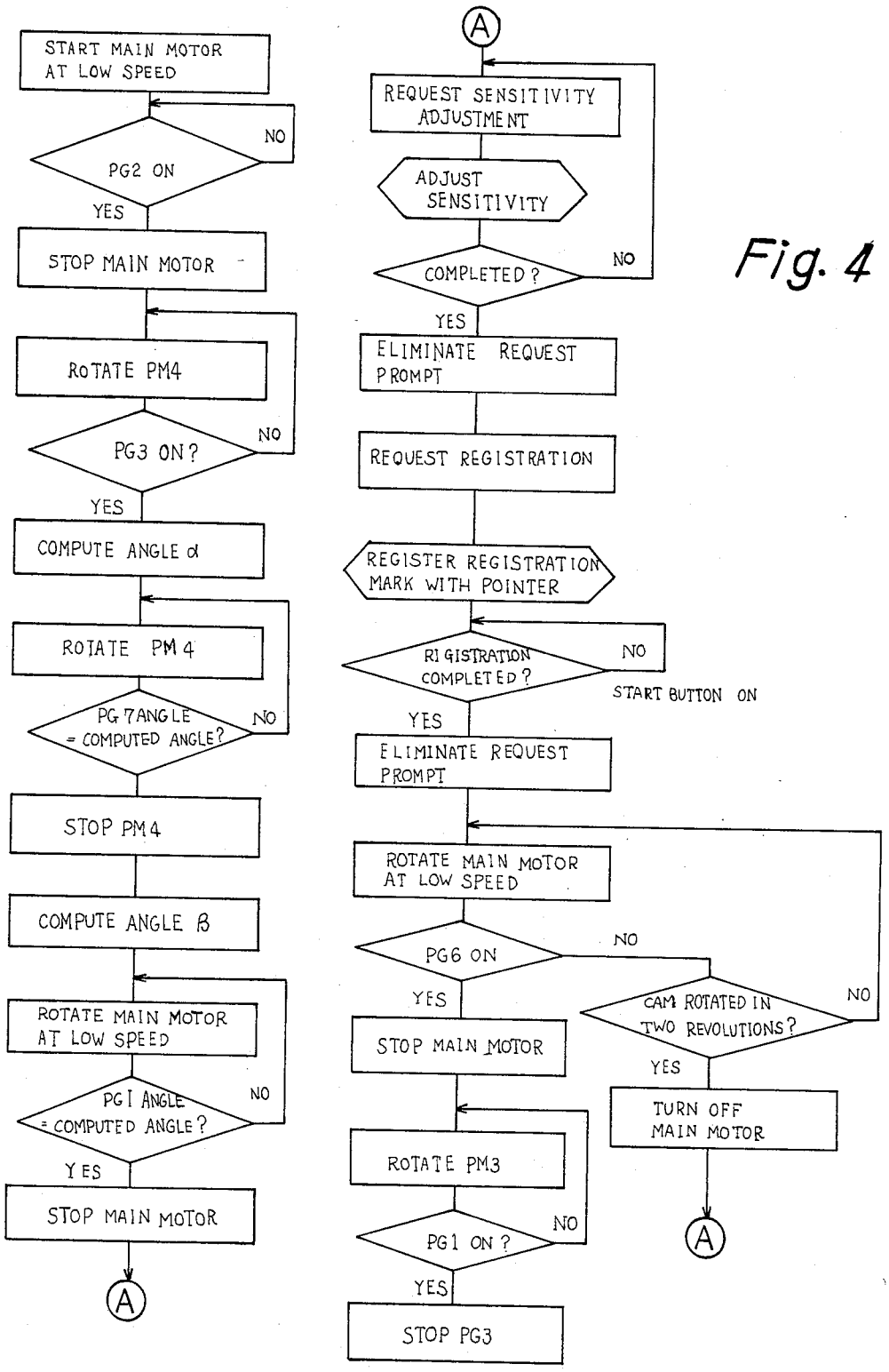
FIG. 4 is a flowchart showing operations of the timing adjustment device illustrated in FIG. 3.

Then, the initial adjustment of the angle of the rotary seal cutter 5 is effected in a process flowcharted as shown in FIG. 4. The main motor M starts being driven to rotate at a low speed. When the pulse generator PG2 is turned on, the main motor M is de-energized. The control motor PM4 is driven to rotate the rotary seal cutter 5 to a preset position in which the pulse generator PG3 is turned on. Then, the feed conveyor 1 is stopped in a position in which the distance between an attachment 1*a* thereon and the central line of the rotary cutter 5 becomes l. The processor 37 reads necessary numerical data from the memory 38 and finds an initially adjusted angle $\alpha$ of the rotary seal cutter 5 by effecting the following arithmetic operation:

$$\alpha = 360° \times \left( \frac{\text{cutting pitch} - m}{\text{cutting pitch}} - \frac{h}{2 \text{ cutting pitches}} - \frac{12}{\text{cutting pitch}} \right)$$

where m is the fractions to the decimal point of l/cutting pitch, and h is the thickness of articles to be wrapped. The control motor PM4 is energized again, and the angle of the rotary seal cutter 5 is brought into conformity with the result $\alpha$ of the above arithmetic operation by a signal from the pulse generator PG7.

Subsequently, an angle $\beta$ of the rotary seal cutter 5 in registering the latter with a registration mark on the patterned wrapping paper is determined by the arithmetic unit 37 according to the following arithmetic operation:

$$\beta = 360° \times \frac{\text{cutting pitch} - r}{\text{cutting pitch}}$$

where r is the fractions to the decimal point of n/cutting pitch, with n being the distance from the registration pointer to the central line of the rotary seal cutter 5. The main motor M is then driven to rotate at a low speed. The angle of the rotary seal cutter 5 is equalized to the computed value $\beta$ by a signal from the pulse generator PG1, and then the main motor M is de-energized.

Then, a sensitivity adjustment request from the pulse generator PG6 for detecting a registration mark on the wrapping paper is displayed on the display unit 40. The sensitivity of the pulse generator PG6 for detecting the registration mark is manually confirmed. Thereafter, a start button is depressed to complete the sensitivity adjustment. The request prompt now disappears from the display unit 40.

Thereafter, a registration request is displayed on the display unit 40. A registration mark on the wrapping paper is manually brought into the pointer 30. After the registration, the start button is turned on to eliminate the request prompt, and the main motor M starts rotating at a low speed. The web of wrapping paper is advanced until the registration mark is detected by the pulse generator PG6 at a preset position, whereupon the main motor M is stopped. In case no registration mark is detected by the pulse generator PG6 after the timing cam shaft 34 has made two or more revolutions, the operation from the sensitivity request display is repeated. After the main motor M has brought to a stop, the control motor PM3 is driven to rotate the timing cam shaft 34. When the pulse generator PG1 is turned on at a certain angular position of the timing cam shaft 34, the control motor PM3 is stopped, and the adjustment of the timing of operation of the rotary seal cutter 5 with respect to the patterned wrapping paper is finished.

Under this condition, the horizontal packaging machine starts operating. Errors due to displacement of the registration marks and other causes during operation are automatically corrected by the pulse generators and control motors. When errors produced are greater than a correctable range, such a condition is detected as a malfunction, and the packaging machine is stopped.

While in the illustrated embodiment the seal cutter is employed for simultaneously sealing and cutting the wrapping paper, there may instead be employed a sealer for effecting only sealing on the wrapping paper or a cutter for effecting only cutting on the wrapping paper with the sealer and cutter being adjusted for their timing of operation.

The illustrated seal cutter rotates in completely circular motion. However, it may be arranged to rotate while horizontally moving at a portion thereof in contact with the wrapping paper as disclosed in U.S. Pat. Nos. 4,120,235, 3,850,780, 3,438,173 and 3,237,371. Furthermore, a sealer and a cutter may be separately arranged with the sealer or the cutter movable upwardly and downwardly as disclosed in U.S. Pat. No. 3,328,936.

With the arrangement of the present invention, the timing adjustment device has an electronic controller for automatically effecting initial adjustment of an angle or position of a seal cutter, a sealer or a cutter, and also setting the timing of rotation or operation of the seal cutter, sealer or cutter with respect to a registration mark printed on a web of patterned wrapping paper. These adjustments can therefore be carried out accurately and efficiently even by an unskilled operator. There is no possibility of causing adjustment errors and leaving something to be adjusted. Accordingly, improperly wrapped articles are not produced which would otherwise result from such adjustment errors. The thickness of articles is set and stored in the memory and the stored data is used in arithmetic operations for initial and timing adjustment of the seal cutter, sealer or cutter. This allows accurate adjustment of the timing of operation of the seal cutter, sealer or cutter with respect to the wrapping paper even when articles of a different thickness are to be wrapped.

Although a certain preferred embodiment has been shown and described, it should be understood that many changes and modifications may be made therein without departing from the scope of the appended claims.

What is claimed is:

1. A timing adjustment device for a packaging machine which includes a feed conveyor for articles to be packaged, a web of patterned wrapping paper for packaging said articles, and a seal cutter for sealing and cutting the packages, comprising:

(a) input means for setting as digital signals values of a cutting pitch of said seal cutter and a thickness of said articles to be wrapped by said web of patterned wrapping paper;

(b) a memory for storing dimensional and numerical data including a dimension from said feed conveyor to said seal cutter, a dimension from a registration mark pointer to said seal cutter, the cutting pitch, the article thickness, and an angle of said seal cutter;

(c) a processor for reading said dimensions and numerical values from said memory, computing an initial angle to derive timing of operation of said seal cutter with respect to said articles fed by said feed conveyor and said patterned wrapping paper, and feeding a control signal based on the result of said computation to a motor drive control unit;

(d) a first control motor coupled through a first differential gear mechanism to a drive system for said seal cutter for adjusting the initial angle of said seal cutter with respect to said feed conveyor under the control of said motor drive control unit;

(e) a second control motor connected through a second differential gear mechanism to a timing mechanism for adjusting timing of operation of said seal cutter with respect to said patterned wrapping paper for adjusting a phase of said timing mechanism with said seal cutter serving as a reference under the control of a signal from said motor drive control unit; and (f) a pulse generator for detecting an angular displacement of the drive system for said timing mechanism and said seal cutter and delivering a detected signal to said processor.

2. A timing adjustment device for a packaging machine which includes a feed conveyor for articles to be packaged, a web of patterned wrapping paper for packaging said articles, and a sealer for sealing the packages, comprising:

(a) input means for setting as digital signals values of a sealing pitch of said sealer and a thickness of said articles to be wrapped by said web of patterned wrapping paper;

(b) a memory for storing dimensional and numerical data including a dimension from said feed conveyor to said sealer, a dimension from a registration mark pointer to said sealer, the sealing pitch, the article thickness, and an angle of said sealer;

(c) a processor for reading said dimensions and numerical values from said memory, computing an initial angle to derive timing of operation of said sealer with respect to said articles fed by said feed conveyor and said patterned wrapping paper, and feeding a control signal based on the result of said computation to a motor drive control unit;

(d) a first control motor coupled through a first differential gear mechanism to a drive system for said sealer for adjusting the initial angle of said sealer with respect to said feed conveyor under the control of said motor drive control unit;

(e) a second control motor connected through a second differential gear mechanism to a timing mechanism for adjusting timing of operation of said sealer with respect to said patterned wrapping paper for adjusting a phase of said timing mechanism with said sealer serving as a reference under the control of a signal from said motor drive control unit; and (f) a pulse generator for detecting an angular displacement of the drive system for said timing mechanism and said sealer and delivering a detected signal to said processor.

3. A timing adjustment device for a packaging machine which includes a feed conveyor for articles to be packaged, a web of patterned wrapping paper for packaging said articles, and a cutter for cutting the packages, comprising:

(a) input means for setting as digital signals values of a cutting pitch of said cutter and a thickness of said articles to be wrapped by said web of patterned wrapping paper;

(b) a memory for storing dimensional and numerical data including a dimension from said feed conveyor to said cutter, a dimension from a registration mark pointer to said cutter, the cutting pitch, the article thickness, and an angle of said cutter;

(c) a processor for reading said dimensions and numerical values from said memory, computing an initial angle to derive timing of operation of said cutter with respect to said articles fed by said feed conveyor and said patterned wrapping paper, and feeding a control signal based on the result of said computation to a motor drive control unit;

(d) a first control motor coupled through a first differential gear mechanism to a drive system for said cutter for adjusting the initial angle of said cutter with respect to said feed conveyor under the control of said motor drive control unit;

(e) a second control motor connected through a second differential gear mechanism to a timing mechanism for adjusting timing of operation of said cutter with respect to said patterned wrapping paper for adjusting a phase of said timing mechanism with said cutter serving as a reference under the control of a signal from said motor drive control unit; and (f) a pulse generator for detecting an angular displacement of the drive system for said timing mechanism and said cutter and delivering a detected signal to said processor.

4. A timing adjustment device according to claim 1, including a display unit for displaying settings entered into said processor and operation requests.

5. A timing adjustment device according to claim 2, including a display unit for displaying settings entered into said processor and operation requests.

6. A timing adjustment device according to claim 3, including a display unit for displaying settings entered into said processor and operation requests.

* * * * *